US012274403B1

(12) United States Patent
Griffin

(10) Patent No.: US 12,274,403 B1
(45) **Date of Patent: *Apr. 15, 2025**

(54) SHAVING ASSISTANCE PLATFORM

(71) Applicant: Faith A. Griffin, Concord, NC (US)

(72) Inventor: Faith A. Griffin, Concord, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/610,680

(22) Filed: Mar. 20, 2024

Related U.S. Application Data

(63) Continuation of application No. 17/692,860, filed on Mar. 11, 2022, now Pat. No. 11,950,735.

(60) Provisional application No. 63/161,116, filed on Mar. 15, 2021.

(51) Int. Cl.
*A47K 3/28* (2006.01)
*A45D 27/22* (2006.01)

(52) U.S. Cl.
CPC ..... *A47K 3/281* (2013.01); *A45D 27/22* (2013.01)

(58) Field of Classification Search
CPC ..... A47K 3/281; A47C 16/02
USPC ..... 4/611
See application file for complete search history.

(56) References Cited

U.S. PATENT DOCUMENTS

| | | | | |
|---|---|---|---|---|
| 4,489,448 | A | 12/1984 | Cairo | |
| 4,656,678 | A | 4/1987 | Lipski | |
| 4,991,908 | A | 2/1991 | Krechel | |
| 5,579,545 | A | 12/1996 | Beard | |
| 5,848,822 | A | 12/1998 | Wu | |
| 5,920,926 | A | 7/1999 | Torres | |
| 6,957,865 | B1 | 10/2005 | Adams et al. | |
| 7,121,620 | B1 | 10/2006 | Fang | |
| 7,549,702 | B2 | 6/2009 | Meyers | |
| 7,886,376 | B2 * | 2/2011 | Ray | A47K 3/282 4/574.1 |
| 9,204,763 | B1 | 12/2015 | Laberda | |
| D808,672 | S | 1/2018 | Goetz | |
| 9,895,036 | B2 | 2/2018 | Edwards et al. | |
| 10,667,619 | B1 | 6/2020 | Blake | |
| 10,674,874 | B1 | 6/2020 | Guidarelli | |
| 2006/0026751 | A1 | 2/2006 | Matthews | |
| 2010/0187041 | A1 | 7/2010 | Crouch | |
| 2015/0359390 | A1 * | 12/2015 | Goetz | A47K 3/281 4/611 |
| 2017/0079480 | A1 | 3/2017 | Tsibulevskiy et al. | |

* cited by examiner

*Primary Examiner* — Christine J Skubinna
(74) *Attorney, Agent, or Firm* — NEO IP

(57) ABSTRACT

The present invention is directed to a platform used to support a person's leg during shaving. The platform includes a plurality of anti-slip feet used to stabilize the platform in a wet environment, such as a shower. The platform includes a plurality of telescoping legs pivotably attached to a base, such that the platform is able to be collapsed for ease of portability and storage and is adjustable to the height of a user. The platform further includes an upper surface having a recessed compartment for storing supplies related to shaving and/or other shower supplies. The platform includes a plurality of holes for facilitating water runoff and at least one cutout for receiving a user's hand for carrying purposes.

20 Claims, 14 Drawing Sheets

SHAVING ASSISTANCE PLATFORM

CROSS-REFERENCES TO RELATED APPLICATIONS

This application relates to and claims priority from the following U.S. Patent Applications: this application is a continuation of U.S. application Ser. No. 17/692,860, filed Mar. 11, 2022, which claims priority to and the benefit of U.S. Provisional Patent Application No. 63/161,116, filed Mar. 15, 2021. Each of the U.S. Applications mentioned above is incorporated herein by reference in its entirety.

BACKGROUND OF THE INVENTION

1. Field of the Invention

The present invention relates to platforms for supporting a person's foot, and more specifically to anti-slip shower platforms for facilitating shaving of a person's legs.

2. Description of the Prior Art

It is generally known in the prior art to provide surfaces on which a user is able to place their foot while in a shower or bathtub.

Prior art patent documents include the following:

U.S. Pat. No. 4,656,678 for Bath tub stool by inventor Lipski, filed Oct. 4, 1985 and issued Apr. 14, 1987, discloses a stool which can be placed in a bath tub. It is intended for use by invalids and otherwise handicapped or elderly persons. It comprises a seat with detachably or foldably connected legs. The seat has an extension or extensions on to which soap and other requisites can be placed.

U.S. Pat. No. 7,549,702 for Foldable bath seat by inventor Meyers, filed Apr. 30, 2007 and issued Jun. 23, 2009, discloses a foldable bath seat including at least a seat member and two leg assemblies each having two legs connected with a crossbar. Each of the crossbars is pivotally mounted to a bottom seat portion to allow the legs to pivot between a folded position and a downwardly extended position.

U.S. Pat. No. 7,121,620 for Foldable bath bench by inventor Fang, filed Aug. 12, 2005 and issued Oct. 17, 2006, discloses a foldable bath bench having a seat assembly and two leg assemblies. The seat assembly has a front, a rear, two opposite sides, two transverse crossbars and at least one seat. The transverse crossbars are mounted respectively at the front and rear, and each transverse crossbar has two opposite ends. The at least one seat is mounted on the transverse crossbars. The leg assemblies are mounted on the opposite sides of the seat assembly, and each leg assembly has two bracket assemblies, and two vertical supports and two legs. The vertical supports are attached respectively to the bracket assemblies and are able to pivot relative to the ends of the transverse crossbars. The legs are mounted respectively on the vertical supports. The foldable bath bench becomes more compact by folding the vertical supports of the leg assemblies relative to the seat assembly for carrying and storage.

U.S. Pat. No. 5,848,822 for Folding collapsible chair by inventor Wu, filed Apr. 1, 1997 and issued Dec. 15, 1998, discloses a folding collapsible chair including a seat plate having a first longitudinal coupling groove and a second longitudinal coupling groove bilaterally disposed at a bottom side thereof, a plurality of vertical through holes, and two hand holes transversely disposed near two opposite ends; a folding stand adapted for supporting the seat plate, the folding stand including a first U-tube and a second U-tube pivoted together, and four retracting legs respectively mounted in two opposite ends of each of the first U-tube and the second U-tube, the first U-tube having a middle section peripherally forced into engagement with the first longitudinal coupling groove of the seat plate and turned therein, the second U-tube having a middle section adapted to be peripherally forced into engagement with the second longitudinal coupling groove of the seat plate; and a locating plate fixedly mounted on the bottom side of the seat plate over the middle section of the first U-tube to secure the seat plate and the first U-tube together.

U.S. Pat. No. 9,895,036 for Adjustable toilet footrest and method of use by inventors Edwards et al., filed May 15, 2015 and issued Feb. 20, 2018, discloses adjustable toilet footrests while using a toilet. In one embodiment, an adjustable toilet footrest comprises a foot platform having at least two telescopic legs extending therefrom, wherein the telescopic legs have a locking mechanism that allows for the height of the platform to be selectively adjusted to a user's desire.

U.S. Pat. No. 6,957,865 for Adjustable chair by inventors Adams et al., filed Apr. 14, 2004 and issued Oct. 25, 2005, discloses an adjustable leg for a chair includes a leg housing, secured to a seat, that includes a threaded inner wall. A leg extension is received into the leg housing and includes external threaded portions that mate with the threaded inner wall. A tab in the leg housing cooperates with the external threaded portions and secures the leg extension at a predefined position in the leg housing.

U.S. Pat. No. 4,489,448 for Foot support for showers by inventor Cairo, filed May 10, 1983 and issued Dec. 25, 1984, discloses a foot support for use in a shower stall or bathtub enclosure during showering, whereon a person can rest or support his foot while applying soap thereto, the support including a series of indentation therein that confirm to a bather's foot, either left or right, wherein the foot is rested and supported as it is soaped, eliminating slippage thereof as it is pivoted and canted as it is washed.

U.S. Pat. No. 10,667,619 for Adjustable foot support stand by inventor Blake, filed Apr. 19, 2018 and issued Jun. 2, 2020, discloses an elevated foot support stand comprising a telescopic leg supported on ground by three leg supports and providing a platform fixed to the telescopic leg at top end thereof. The telescopic leg allows for adjusting the height of the platform above the ground. The leg supports are foldable for convenient storage of the foot support stand assembly. Further, the platform can be articulated with respect to the telescopic leg for adjusting angle thereof, and for folding during storage. The foot support stand can be used to support the foot while performing a pedicure, shaving one's legs or applying medication to the foot among other things.

U.S. Pat. No. 5,579,545 for Combined foot support and grooming needs holder by inventor Beard, filed May 5, 1995 and issued Dec. 3, 1996, discloses a combined foot support and grooming needs holder device, designed to securely provide elevation and support for a human foot and grooming needs, while washing, drying, pedicuring the foot or shaving the leg, for use inside or outside of the shower or bath tub. The invention consists of a two-part single legged elongate support member and a two-part platform, so that the human foot and grooming needs may be located near each other while in use.

U.S. Pat. No. 9,204,763 for Shower pedestals by inventor Laberda, filed Apr. 14, 2015 and issued Dec. 8, 2015, discloses a platform onto which a user can place a foot so as to elevate the leg for ease in shaving and other hygienic functions. For example, a pedestal system can include at least one vertically-oriented, elongate beam member coupled with a perpendicularly-coupled shelf member configured to receive the foot of a user, and one or more coupling mechanisms configured to reversibly couple at least one of the elongate beam members and the shelf member to a structural component such as a wall or floor of a bathtub or shower.

SUMMARY OF THE INVENTION

The present invention relates to platforms for supporting a person's foot.

It is an object of this invention to provide a platform for stably supporting a person's foot in a wet environment, such as a shower.

In one embodiment, the present invention is directed to a platform for facilitating shaving, including a base, a plurality of legs extending outwardly from a bottom surface of the base, a plurality of stabilizers attached to ends of the plurality of legs, wherein the base includes a plurality of openings, configured to allow water to drain from a top surface of the base, wherein the plurality of stabilizers each include a stem portion and a foot portion, wherein the stem portion of the plurality of stabilizers is configured to retract within the plurality of legs, and wherein the foot portion of the plurality of stabilizers is formed from an anti-slip material.

In another embodiment, the present invention is directed to a platform for facilitating shaving, including a base, a plurality of legs extending outwardly from a bottom surface of the base, a plurality of stabilizers attached to ends of the plurality of legs, wherein the base includes a plurality of openings, configured to allow water to drain from a top surface of the base, wherein the plurality of stabilizers each include a stem portion and a foot portion, wherein the stem portion of the plurality of stabilizers is configured to retract within the plurality of legs, and wherein the plurality of legs are pivotably attached to the base, and wherein the plurality of legs are operable to fold inwardly toward the center of the base.

In yet another embodiment, the present invention is directed to a platform for facilitating shaving, including a base, a plurality of legs extending outwardly from a bottom surface of the base, a plurality of stabilizers attached to ends of the plurality of legs, wherein the base includes a plurality of openings, configured to allow water to drain from a top surface of the base, wherein the plurality of stabilizers each include a stem portion and a foot portion, wherein the stem portion of the plurality of stabilizers is configured to retract within the plurality of legs, wherein the plurality of legs are pivotably attached to the base, and wherein the plurality of legs are operable to fold inwardly toward the center of the base, wherein the foot portion of the plurality of stabilizers is formed from an anti-slip material, and the top surface of the base includes at least one recess, configured to receive and contain shower supplies.

These and other aspects of the present invention will become apparent to those skilled in the art after a reading of the following description of the preferred embodiment when considered with the drawings, as they support the claimed invention.

DETAILED DESCRIPTION

Figure 1:
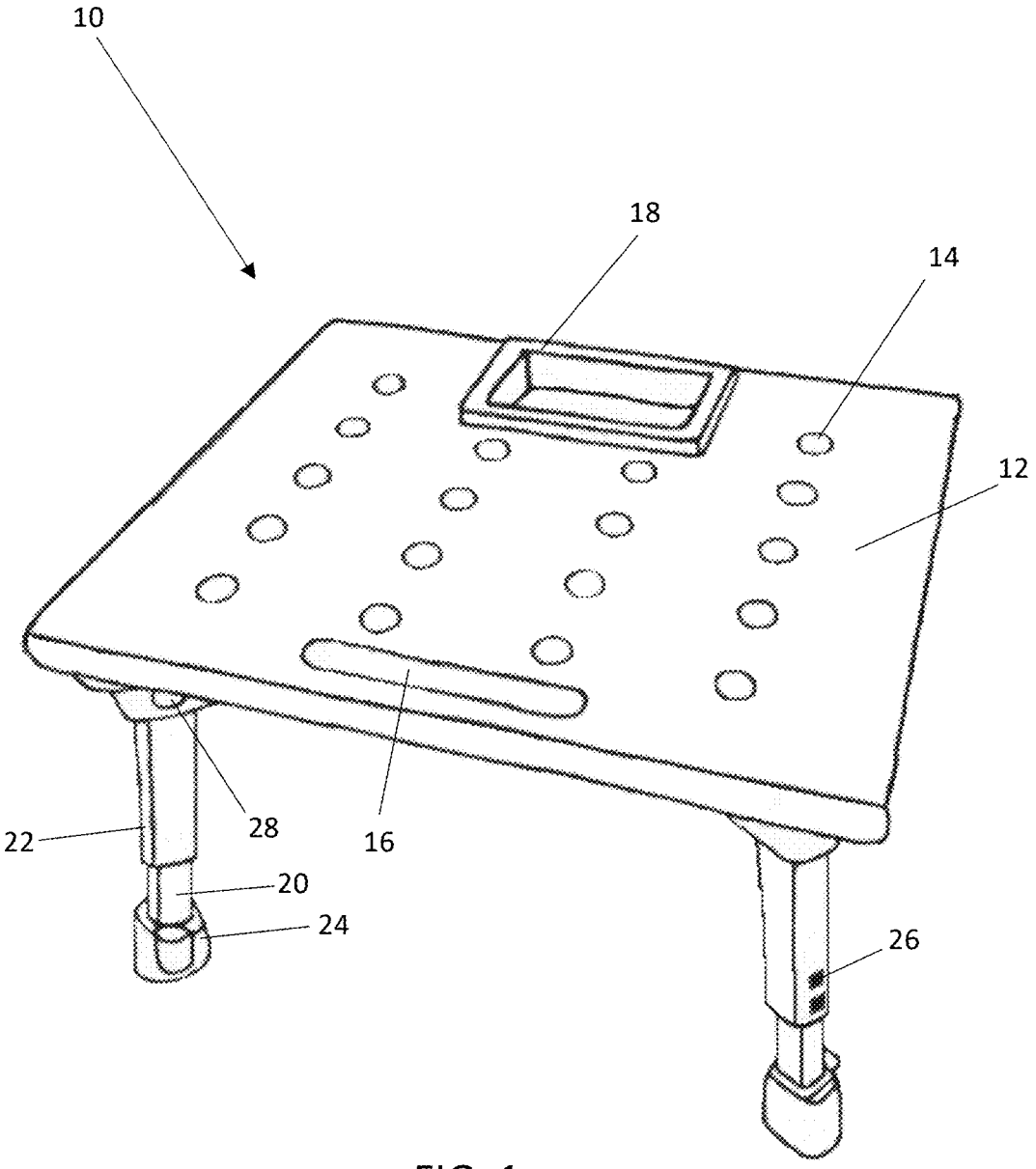
FIG. 1 illustrates an isometric view of a platform according to one embodiment of the present invention.

The present invention relates to platforms for supporting a person's foot.

In one embodiment, the present invention is directed to a platform for assisting shaving in a wet environment.

In one embodiment, the present invention is directed to a platform for facilitating shaving, including a base, a plurality of legs extending outwardly from a bottom surface of the base, a plurality of stabilizers attached to ends of the plurality of legs, wherein the base includes a plurality of openings, configured to allow water to drain from a top surface of the base, wherein the plurality of stabilizers each include a stem portion and a foot portion, wherein the stem portion of the plurality of stabilizers is configured to retract within the plurality of legs, and wherein the foot portion of the plurality of stabilizers is formed from an anti-slip material.

In another embodiment, the present invention is directed to a platform for facilitating shaving, including a base, a plurality of legs extending outwardly from a bottom surface of the base, a plurality of stabilizers attached to ends of the plurality of legs, wherein the base includes a plurality of openings, configured to allow water to drain from a top surface of the base, wherein the plurality of stabilizers each include a stem portion and a foot portion, wherein the stem portion of the plurality of stabilizers is configured to retract within the plurality of legs, and wherein the plurality of legs are pivotably attached to the base, and wherein the plurality of legs are operable to fold inwardly toward the center of the base.

In yet another embodiment, the present invention is directed to a platform for facilitating shaving, including a base, a plurality of legs extending outwardly from a bottom surface of the base, a plurality of stabilizers attached to ends of the plurality of legs, wherein the base includes a plurality of openings, configured to allow water to drain from a top surface of the base, wherein the plurality of stabilizers each include a stem portion and a foot portion, wherein the stem portion of the plurality of stabilizers is configured to retract within the plurality of legs, wherein the plurality of legs are pivotably attached to the base, and wherein the plurality of legs are operable to fold inwardly toward the center of the base, wherein the foot portion of the plurality of stabilizers is formed from an anti-slip material, and the top surface of the base includes at least one recess, configured to receive and contain shower supplies.

None of the prior art discloses a stable platform able to be used in a wet environment without slipping, while providing adequate support for a resting foot.

Slipping and falling in a bathroom frequently causes injury, as it leads people to hit their heads or other body parts against hard surfaces. According to the CDC, approximately 235,000 people visit emergency rooms each year due to bathroom injuries, with 53% of all bathroom slip and falls occurring in the shower or bathtub in 2019. Slipping and falling is more likely to occur when an individual is an unbalanced position, such as when they have a leg lifted up for shaving purposes.

Approximately 85% of women shave their legs, with many women doing so in the shower. Furthermore, many people also exfoliate their skin or polish or paint their toenails in the shower, each of which often require that a person props up their leg in order to reach their foot. While products currently exist for supporting legs while shaving in the shower, existing technology suffers from serious design flaws that contributes to increased risk of slippage. For example, some existing leg supports rely on specific shower geometries, such as having corners in the shower with approximately right angles. However, such supports are unable to be used if the shower has rounded edges or if the shower is positioned over a bathtub. Other supports have legs and a top surface that are integrally formed from a weakened, bendable polymer. This means that if moderate force is applied to the top surface of the support, the legs easily buckle, potentially causing the user's foot to slip and the user to fall. In addition, the majority of existing shower support technology is not adjustable depending on the height of the user, meaning that different supports often need to be bought for each individual user. Existing adjustable bath stools lack non-slip contact surfaces for wet ground, meaning they are not suitably for providing the sort of stability required for a shaving support.

Furthermore, existing shower supports are not easily portable. The devices typically consist of a platform and legs. However, the platform and leg design makes for a bulky product that is inconvenient to store away. Therefore, there is a need for a shower support that is easily foldable and therefore is able to be efficiently stored.

Referring now to the drawings in general, the illustrations are for the purpose of describing one or more preferred embodiments of the invention and are not intended to limit the invention thereto.

Figure 6:
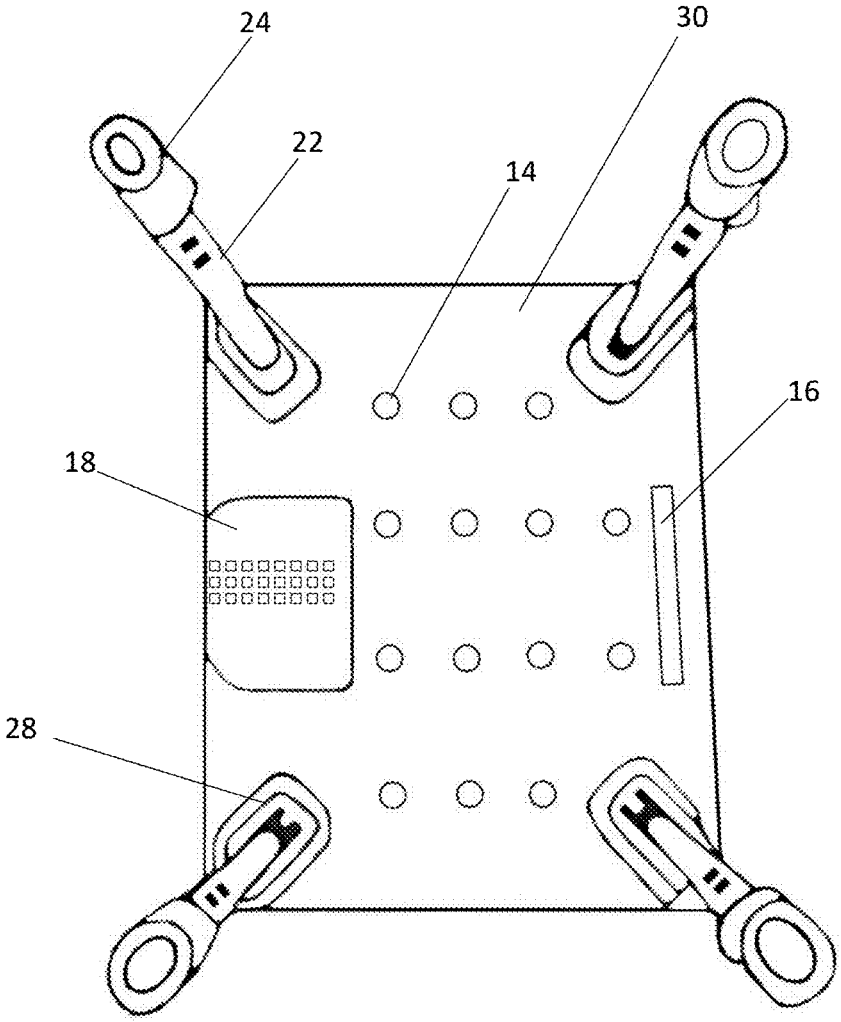
FIG. 6 illustrates a bottom orthogonal view of a platform, with legs stretched outward, according to one embodiment of the present invention.

FIG. 1 illustrates an isometric view of a platform according to one embodiment of the present invention. The platform 10 includes a base 11 having a top surface 12 including a plurality of holes 14. The plurality of holes 14 allow for water and/or other fluids to drain away from the surface of the platform 10, allowing for the top surface 12 to remain relatively less wet than a surface without any holes and decreasing the chance of slipping. In one embodiment, the top surface 12 of the base 11 is formed from and/or coated with a hydrophobic material, such as polyvinyl chloride, poly(methyl methacrylate) (PMMA), high-density polyethylene (HDPE), polyvinylidene fluoride, and/or carbon nanotubes. In one embodiment, the top surface 12 of the base 11 includes a grip 16. In one embodiment, the grip 16 is a hole extending through the base 11 of the platform 10. The grip 16 is configured to receive a user's fingers the grip 16 in order to allow the user to grab the platform 10. In another embodiment, the grip 16 is a raised section of the top surface 12 configured for a user to grasp in order to carry the platform 10. In yet another embodiment, the platform 10 includes at least two grips extending outwardly from the bottom surface of the base 11 of the platform 10, such that a user is able to hold each grip with one hand in order to order to lift the platform 10. In one embodiment, the at least two grips extend outwardly from opposite sides of the base 11. One of ordinary skill in the art will understand that although FIG. 1 shows a platform having 18 holes and FIG. 6 shows a platform having 14 holes, platforms having greater or fewer numbers of holes are also contemplated by the present invention.

Figure 3:
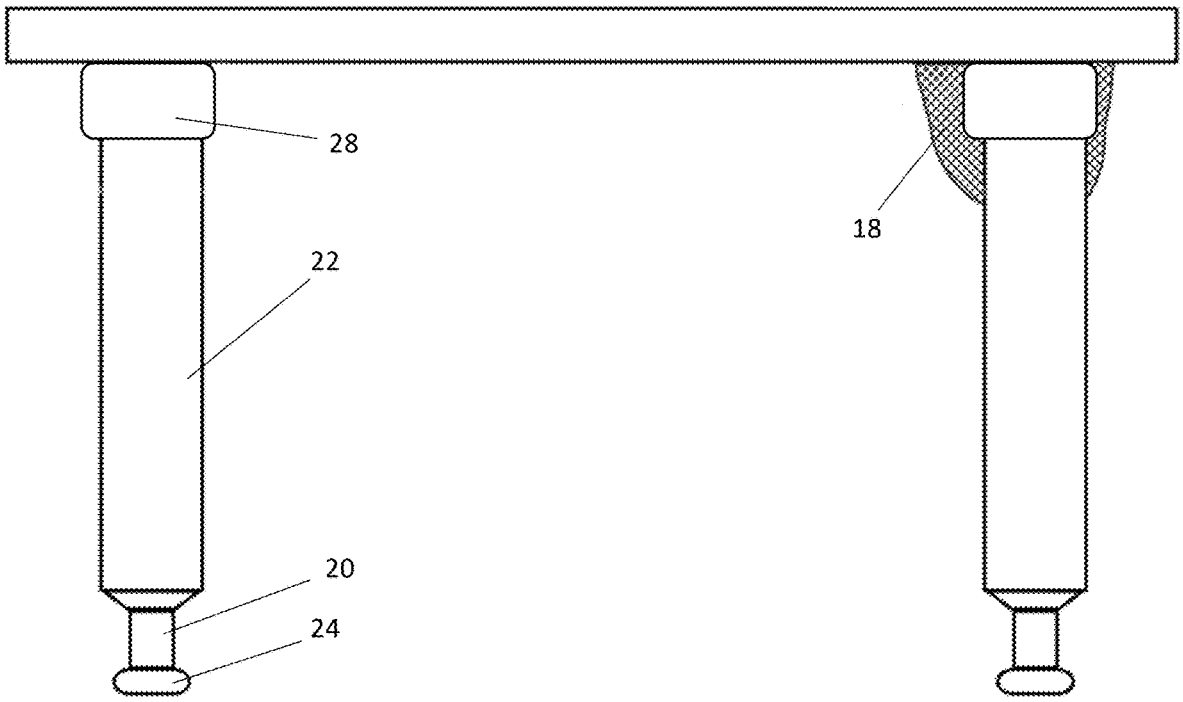
FIG. 3 illustrates a side orthogonal view of a platform having a mesh receptacle according to one embodiment of the present invention.

In one embodiment, the platform 10 also includes a receptacle 18 for storing objects. In one embodiment, as shown in FIG. 1, the receptacle 18 is an open compartment on the top surface 12 with a recess for depositing items. In another embodiment, the receptacle 18 includes a cover able to slide in order to open or close the receptacle 18. In yet another embodiment, the receptable 18 includes a hinge connected to a lid, which is sized to cover the receptacle 18. In one embodiment, receptacle 18 includes a plurality of holes, such that water and/or other fluids do not accumulate in the receptacle 18. A user of the platform 10 is able to store, for example, a razor, shaving cream, extra razor blades, skin care products, and/or other materials needed for shaving or other shower needs in the receptacle 18. In one embodiment, the receptacle is formed from a stiff polymer material, including but not limited to, polypropylene, polyvinyl chloride, polylactic acid, high-density polyethylene (HDPE), ultra-high molecular weight polyethylene (UHMWPE), or a metal material, including but not limited to steel, aluminum, and/or titanium. In another embodiment, the receptacle includes a flexible material formed into a mesh, as shown in FIG. 3. The mesh is able to be formed from polypropylene, polytetrafluoroethylene, and/or other flexible polymers.

Figure 2:
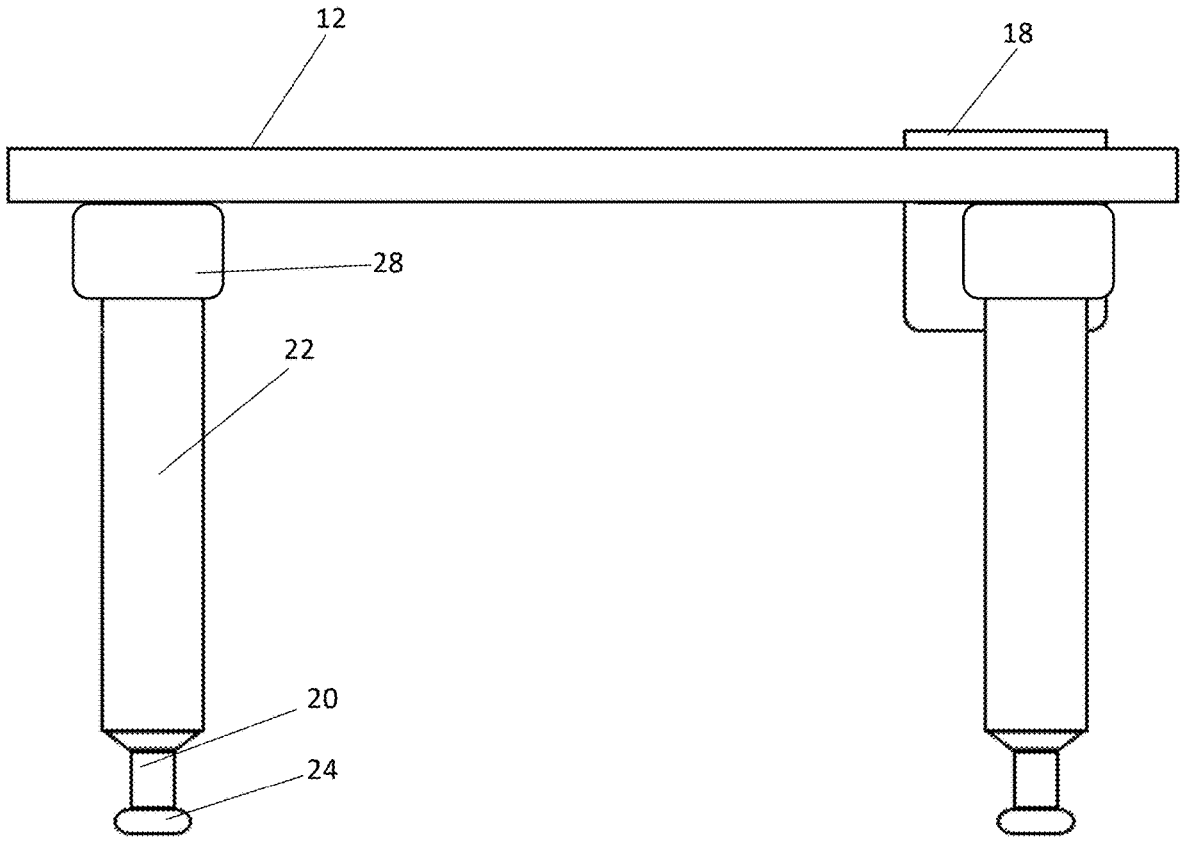
FIG. 2 illustrates a side orthogonal view of a platform according to one embodiment of the present invention.

In one embodiment, the receptacle 18 is removably connected to the platform 10. The platform 10 includes a receptacle hole wherein the receptacle 18 is able to be placed. The receptacle 18 includes a lip surrounding the perimeter of the receptacle 18. When the receptacle 18 is placed into the receptacle hole, the lip contacts the top surface 12 of the platform 10 directly surrounding the receptacle hole. The receptacle 18 is therefore held in place by gravity when the platform 10 is in an upright position. In another embodiment, the receptacle 18 is integrally formed with the top surface 12 of the platform 10. In one embodiment, the lip of the receptacle 18 extends above the top surface 12 of the platform 10. Because the lip of the receptacle 18 extends above the top surface 12, liquid is prevented from flowing from the top surface 12 of the platform into the receptacle 18. The opening to the receptacle 18 is able to be a variety of shapes, including, but not limited to, a rectangle, trapezoid, triangle, circle, or hexagon. In one embodiment, the bottom surface of the receptacle 18 is a flat surface, as shown in FIG. 2. In another embodiment, the bottom surface of the receptacle 18 is curved, as shown in FIGS. 3 and 4.

The top surface 12 of the platform 10 is supported by a plurality of legs 20. In one embodiment, the platform 10 includes four legs 20. In another embodiment, the platform 10 includes three legs. In yet another embodiment, the platform 10 includes greater than four legs. Each of the plurality of legs 20 is attached to a leg sheath 22 and a non-slip foot 24. In one embodiment, the leg sheath 22 is an outer tube having a larger diameter than the legs 20, which is an inner tube capable of fitting into the leg sheath 22. The leg 20 and non-slip foot 24 can be viewed as a single element (e.g., having a stem portion and a foot portion) that is able to move into and out of the leg sheath 22. In one embodiment, each leg 20 is attach to a respective leg sheath 22 via at least one pin extending through a portion of the leg 20 and the respective leg sheath 22. The radius of the cross section of each leg sheath 22 is greater than that of each leg 20, such that the leg 20 is able to fit within the leg sheath 22. An engagement mechanism 26 is operable to slide a portion of each of the plurality of legs 20 into and out of the respective leg sheath 22, allowing for the height of the platform 10 to be adjusted. In one embodiment, the engagement mechanism 26 is attached to the leg sheath 22 and includes a pin that, when pushed, allows for the leg 20 to slide into the leg sheath 22. In another embodiment, a button and/or lever on the leg sheath 22, leg 20, or non-slip foot 24 controls whether the leg 20 is able to freely slide into and out of the leg sheath 22. In yet another embodiment, a latch mechanism surrounds the bottom end of each leg sheath 22. When the latch mechanism is in an open position, the leg 20 is able to slide into and out of the leg sheath 22. When the latch mechanism is in a closed position, the latch mechanism maintains frictional contact with both the leg 20 and the leg sheath 22, preventing the leg 20 from sliding into or out of the leg sheath 22.

In one embodiment, each non-slip foot 24 is connected to a respective leg 20 through frictional contact and/or adhesive. In one embodiment, each non-slip foot 24 includes a recess, wherein a leg 20 fits tightly within the recess of the non-slip foot 24. In one embodiment, the width or radius of the non-slip foot 24 is greater than the width or radius of the leg 20. In another embodiment, the width or radius of the non-slip foot 24 is less than or equal to the width or radius of leg 20. In one embodiment, each non-slip foot 24 is formed from rubber, non-slip PVC, and/or other materials with anti-slip properties. In another embodiment, each non-slip foot 24 includes at least one suction cup. When pressure is applied to the top surface 12 of the platform 10, the suction cups are able to engage with the ground in order to keep the platform 10 in place.

Figure 4:
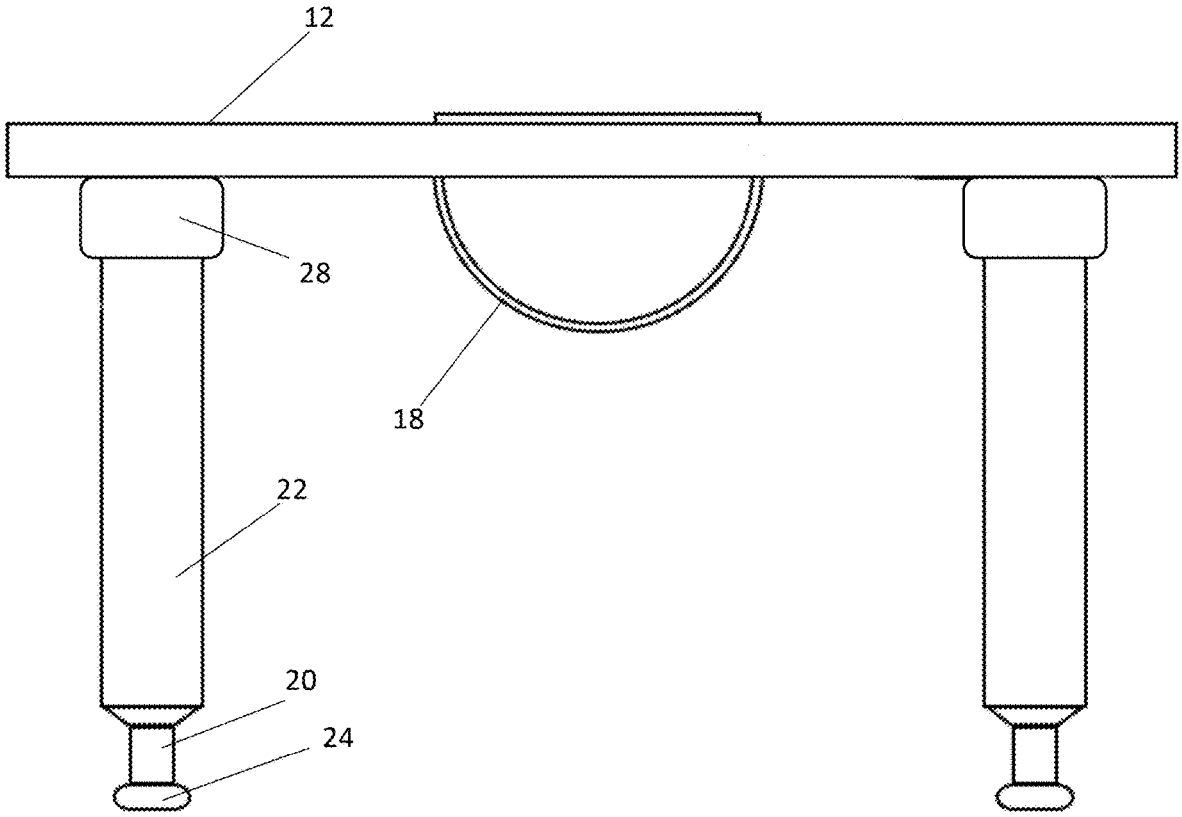
FIG. 4 illustrates a front orthogonal view of a platform according to one embodiment of the present invention.
Figure 5:
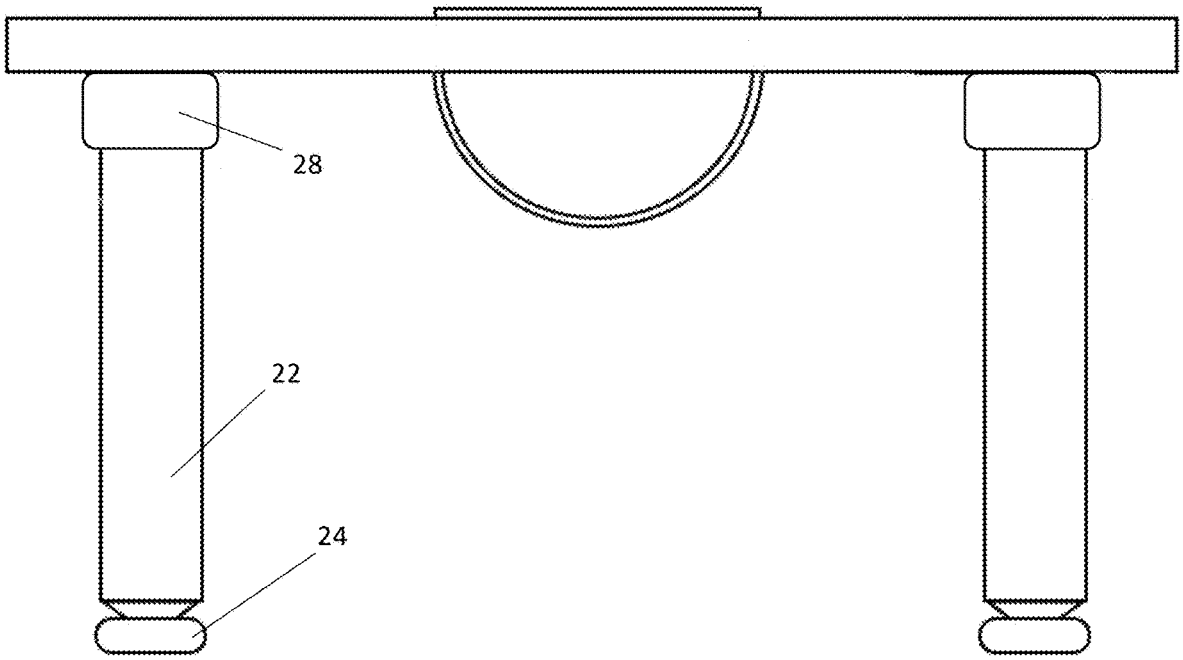
FIG. 5 illustrates a front orthogonal view of the platform of FIG. 4, with legs retracted into leg shafts.

As shown in FIG. 4, when in an extended position, each leg 20 includes at least a portion not covered by a leg sheath 22. However, as shown in FIG. 5, when in a retracted position, each leg 20 is entirely covered by the leg sheath 22, with the non-slip foot 24 of each leg 20 being directly adjacent to the leg sheath 22. In another embodiment, even in a fully retracted position, a portion of each leg 20 is not covered by the leg sheath 22.

FIG. 6 illustrates a bottom orthogonal view of a platform according to one embodiment of the present invention, with legs stretched outward. The platform includes a base 11 having a bottom surface 30. As shown in FIG. 6, the holes 14 extend through from the top surface 12 to the bottom surface 30 of the platform 10. Each leg sheath 22 has a top end opposite that of the non-slip foot 24 nested within and attached to a pivot mechanism 28. In one embodiment, the leg sheath 22 is connected to the pivot mechanism 28 via at least one pin, which allows the leg sheath 22 to pivot within the pivot mechanism 28. In another embodiment, the leg sheath 22 is attached to a hinge within the pivot mechanism 28, which allows the leg sheath to move between outstretched and folded positions.

Figure 7:
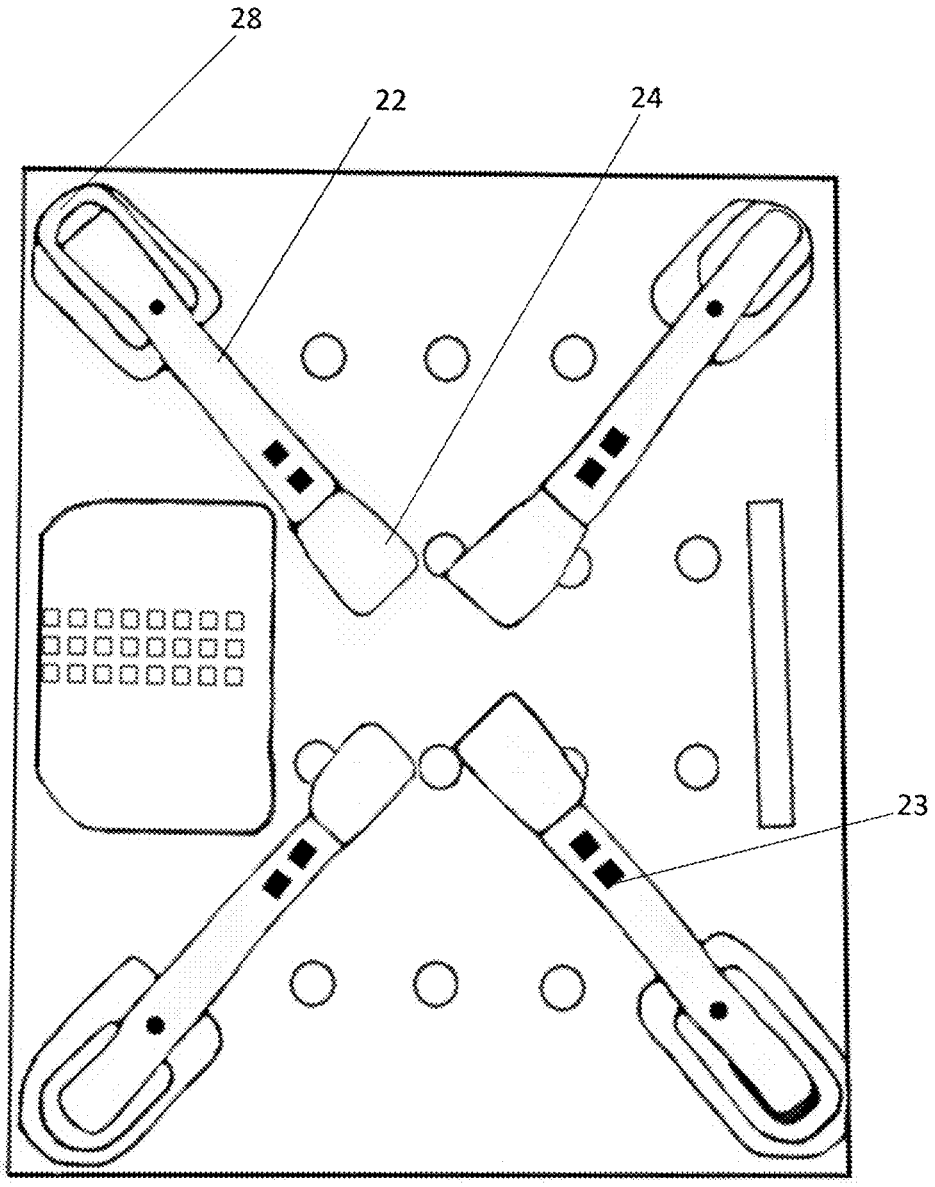
FIG. 7 illustrates a bottom orthogonal view of the platform of FIG. 6, with legs folded inward.

In one embodiment, when in an outstretched position, as in FIG. 6, each leg sheath 22 extends approximately orthogonally to the bottom surface 30 of the platform 10. In another embodiment, when in an outstretched position, the interior angle between each leg sheath 22 and the bottom surface 30 of the base 11 of the platform 10 exceeds 90°. The interior angle being greater than 90° provides additional stability to the platform preventing it from tipping over easily. In one embodiment, the splay angle of the legs 20 is greater than 0°, wherein the splay angle is the angle of the legs relative to the vertical when the platform is viewed from the front. In one embodiment, the rake angle of the legs 20 is greater than 0°, wherein the rake angle is the angle of the legs relative to the vertical when the platform is viewed from the side. As shown in FIG. 7, when in a folded position, each of the leg sheaths 22 lies in a plane substantially parallel to the plane defined by the bottom surface 30 of the base 11 of the platform 10. In one embodiment, the plurality of leg sheaths 22 are only capable of being moved to a fully folded position when each of the legs 20 are fully retracted within a respective leg sheath 22. In another embodiment, the plurality of leg sheaths 22 are capable of being moved to a fully folded position even when each leg 20 is fully extended. In one embodiment, the platform 10 includes a locking mechanism to retain the legs 20 at a specific extension state or retraction state. By way of example and not limitation, locking mechanisms include locking pins 23 and/or latches.

Figure 8:
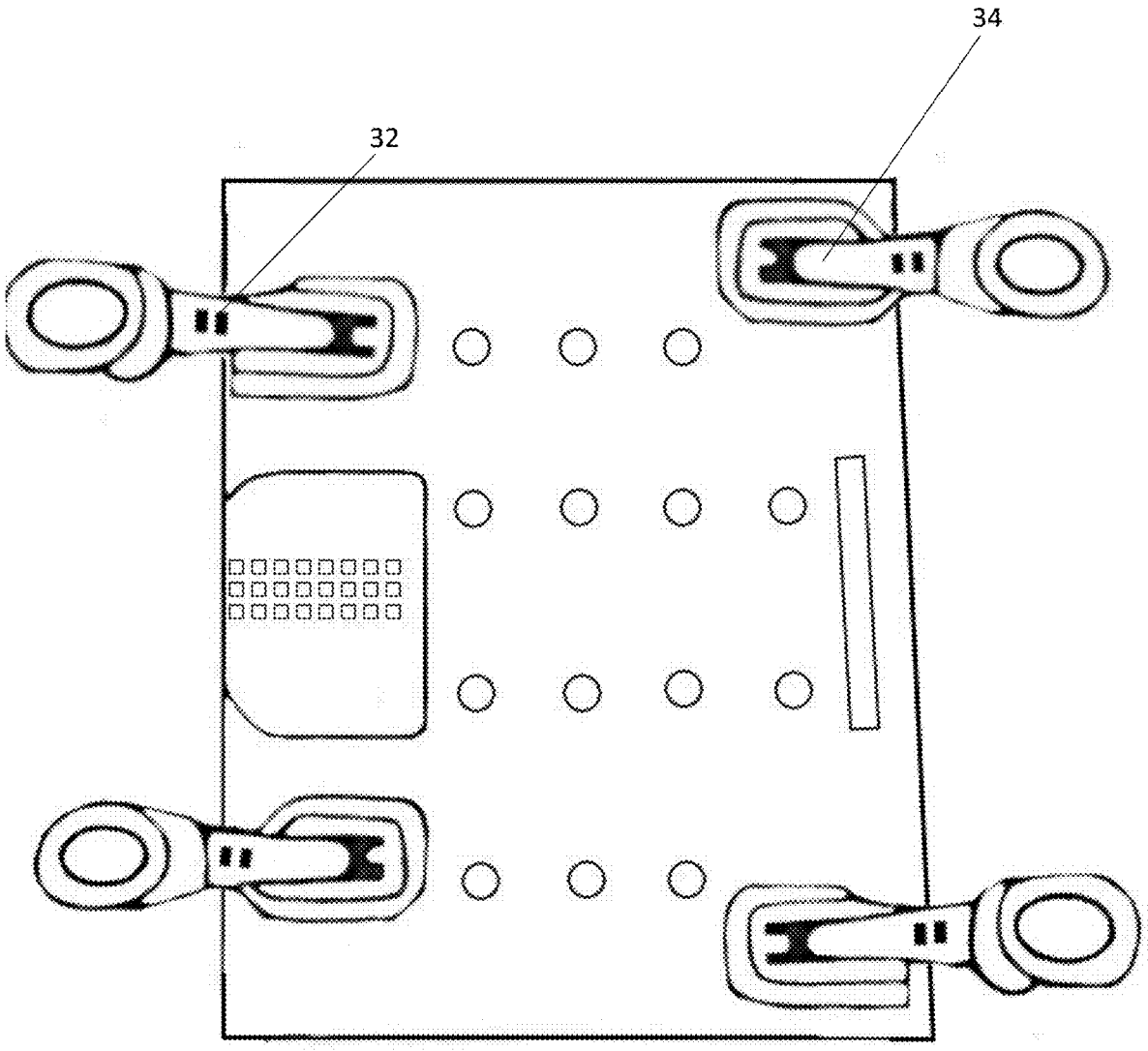
FIG. 8 illustrates a bottom orthogonal view of a platform according to another embodiment of the present invention.
Figure 9:
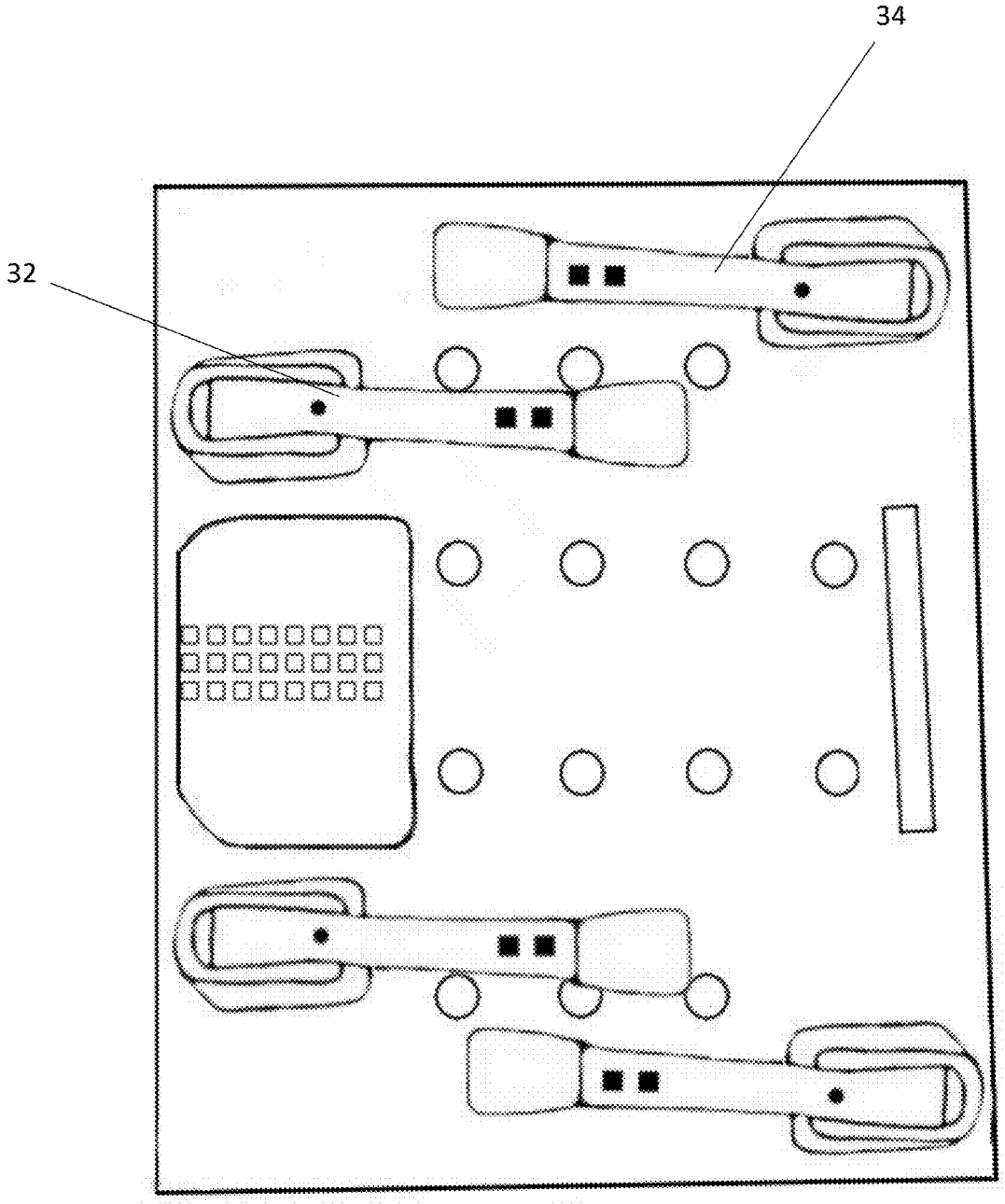
FIG. 9 illustrates a bottom orthogonal view of the platform of FIG. 8, with legs folded inward.
Figure 10:
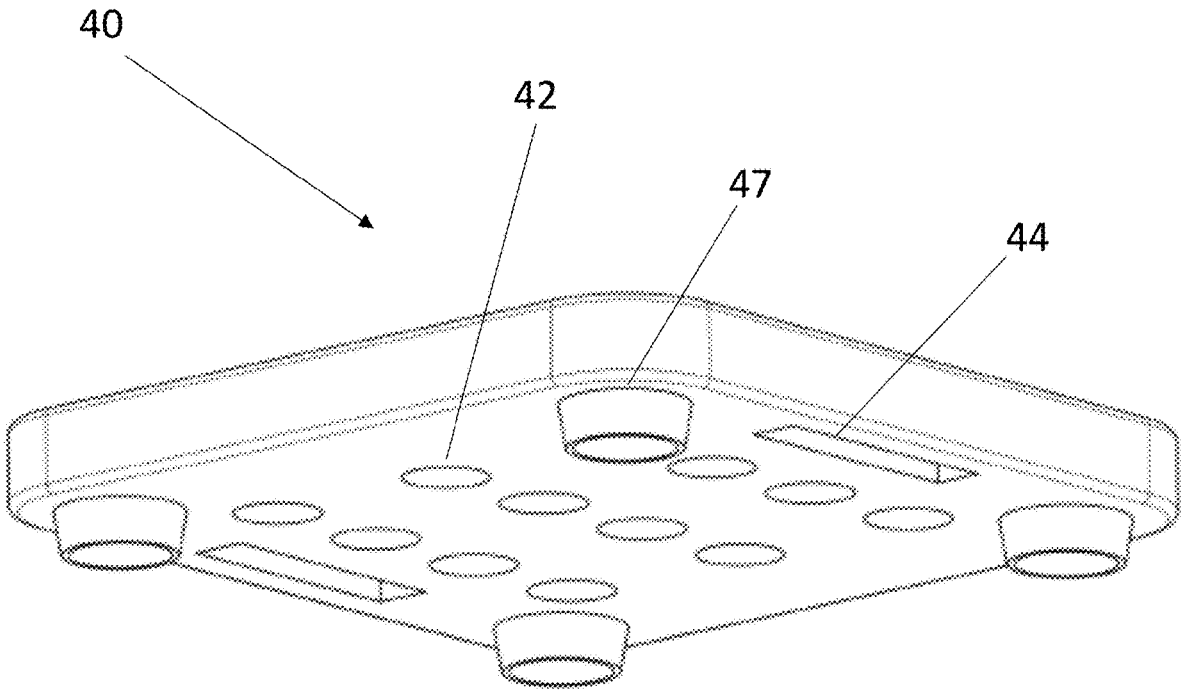
FIG. 10 illustrates an isometric view of a platform according to one embodiment of the present invention.
Figure 11:
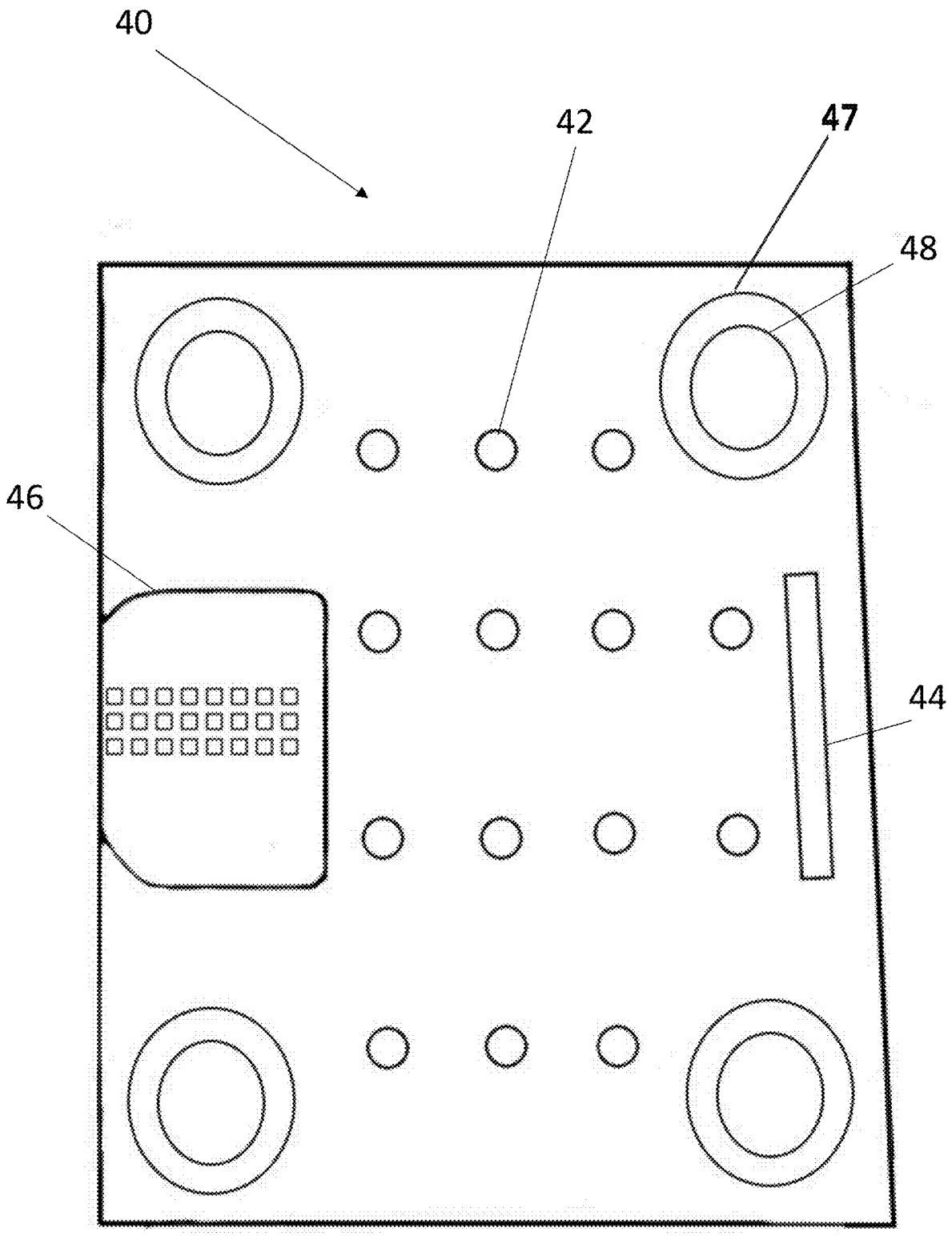
FIG. 11 illustrates a bottom orthogonal view of the platform of FIG. 10.
Figure 12:
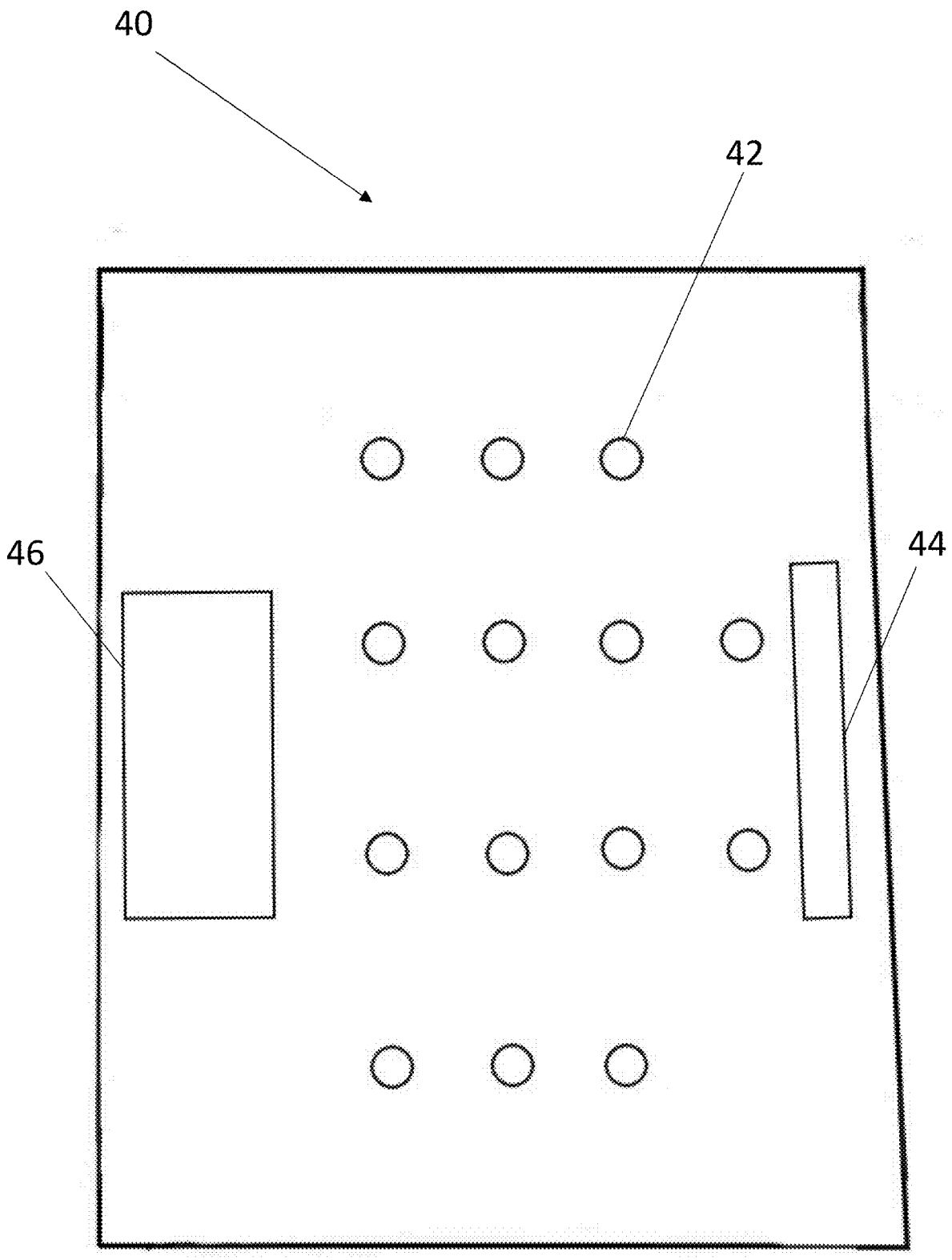
FIG. 12 illustrates a top orthogonal view of the platform of FIG. 10.
Figure 13:
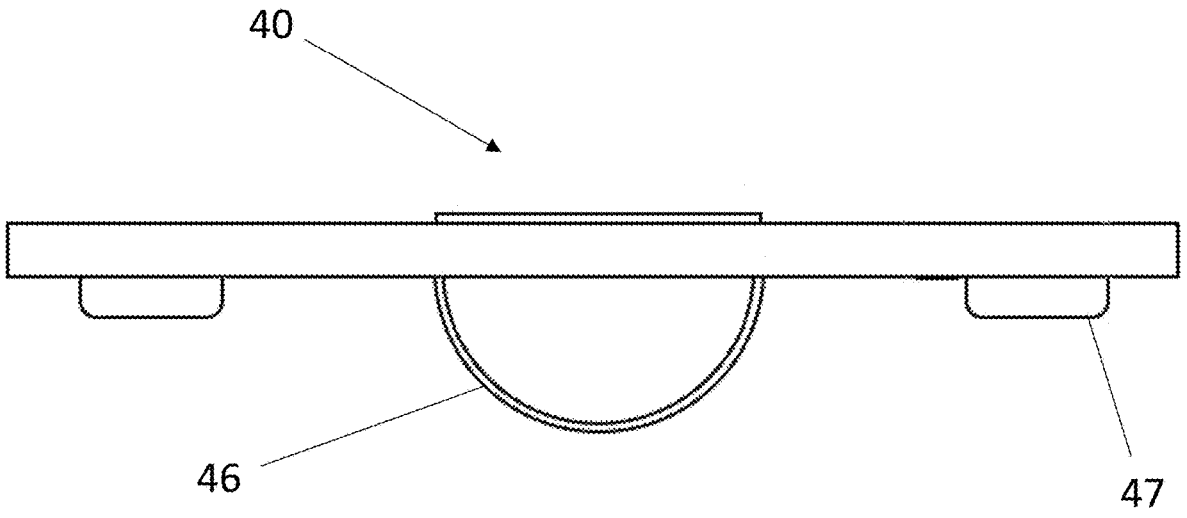
FIG. 13 illustrates a side orthogonal view of the platform of FIG. 10, with legs not attached.
Figure 14:
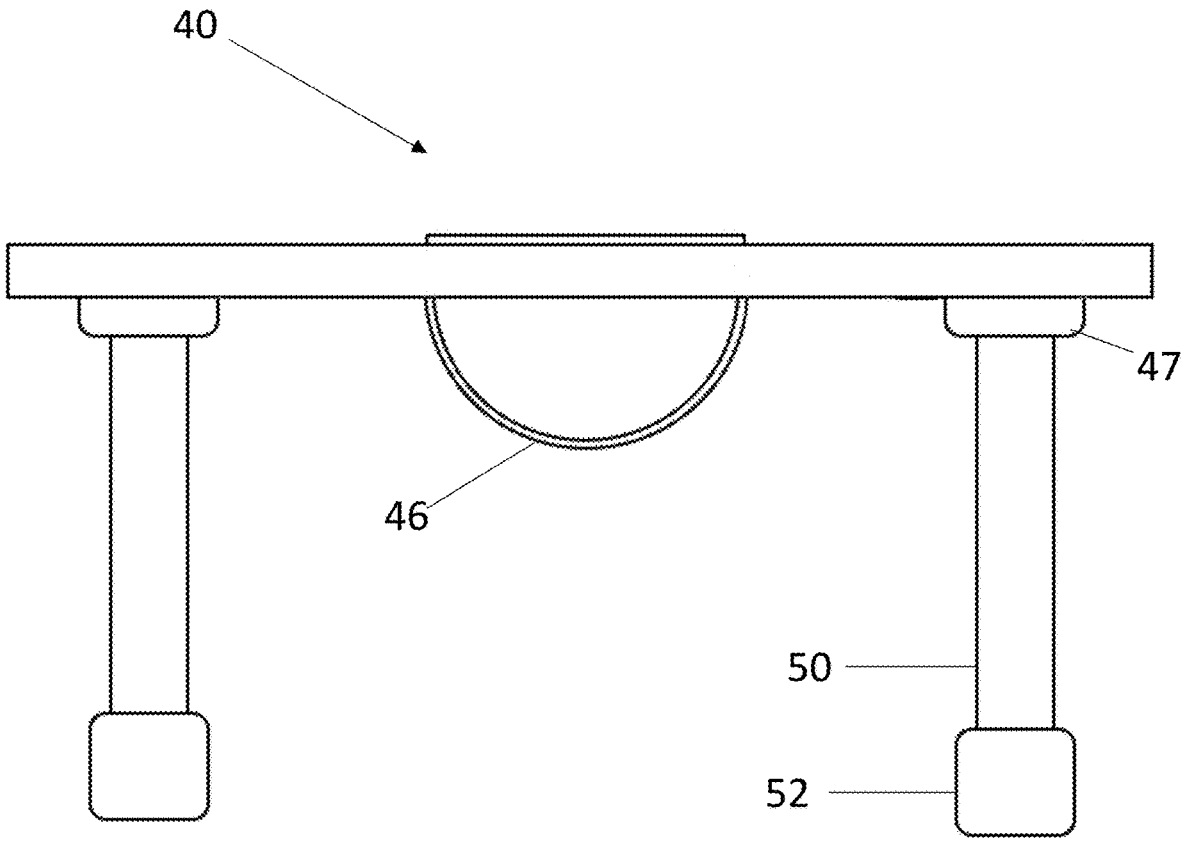
FIG. 14 illustrates a side orthogonal view of the platform of FIG. 10, with legs attached.

In one embodiment, the legs are attached to a corner of a bottom surface of the base of the platform and fold diagonally inwardly toward the center of the base of the platform, as shown in FIGS. 6 and 7. However, one of ordinary skill in the art will understand that other configurations of the legs are also compatible with the present invention. For example, FIGS. 8 and 9 illustrate a bottom orthogonal view of a platform according to another embodiment of the present invention. In one embodiment, one set of legs 34 are attached to opposite sides of the bottom surface of the base of the platform, adjacent to the edge of the platform. Another set of legs 32 are attached at a position closer to the center of the base than the first set of legs 34. In this embodiment, the legs are able to be folded horizontally (e.g., substantially parallel to at least one side of the base of the platform), rather than diagonally without the first set of legs 34 interfering with the ability of the second set of legs 32 to properly fold.

FIGS. 10-14 illustrate a platform according to another embodiment of the present invention. In one embodiment, the platform 40 includes a plurality of holes 42 for allowing water runoff from the surface of the platform 40, at least one opening 44 configured to receive a hand for carrying the platform 40, and at least one item holder 46. Additionally, the platform 40 includes a plurality of ring-shaped bosses 47 protruding from a bottom surface of the platform 40, wherein the plurality of ring-shaped bosses 47 define a plurality of recessions 48 in the bottom surface of the platform 40. The plurality of recessions 48 are configured to receive first ends of a plurality of legs 50, wherein an opposite end of each of the plurality of legs 50 is attached to a rubber foot 52. In one embodiment, the plurality of legs 50 are held in place relative to the platform 40 via frictional contact between the plurality of legs 50 and an interior surface of the plurality ring-shaped bosses 47. In another embodiment, other retention mechanisms are able to be used, such as pins or latches holding the plurality of legs 50 in place. In one embodiment, the plurality of legs 50 include aluminum tubes.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A platform for facilitating shaving, consisting of:
a base;
a plurality of legs extending outwardly from a bottom surface of the base;
a plurality of stabilizers attached to the plurality of legs;
at least one receptacle;
wherein the base includes a first plurality of holes;
wherein the plurality of stabilizers each include a stem portion and a foot portion;
wherein the plurality of legs are pivotably attached to the base, and wherein the plurality of legs are operable to fold along an axis substantially parallel to one or more sides of the base;
wherein the plurality of legs and the plurality of stabilizers are contained under a bottom surface of the base when the stem portions of the plurality of stabilizers are retracted within the plurality of legs and when the plurality of legs are folded along the axis substantially parallel to the one or more sides of the base;
wherein the at least one receptacle extends below the bottom surface of the base;
wherein the at least one receptacle includes a second plurality of holes;
wherein the base includes a first opening for the at least one receptacle; and
wherein the base includes a second opening.

2. The platform of claim 1, wherein the at least one receptacle is mesh or formed of a stiff material.

3. The platform of claim 1, wherein the at least one receptacle is removably connected to the platform.

4. The platform of claim 1, wherein the at least one receptacle includes a cover operable to slide to open or close the at least one receptacle.

5. The platform of claim 1, wherein the top surface of the base is formed and/or coated with at least one hydrophobic material.

6. The platform of claim 1, further comprising a leg sheath attached to at least one leg, wherein the leg sheath is an outer tube having a larger diameter than the plurality of legs.

7. The platform of claim 1, wherein the foot portion of the plurality of stabilizers is formed from an anti-slip material.

8. The platform of claim 1, wherein the plurality of legs each have a splay angle and/or a rake angle greater than 0° when the platform is in an unstretched configuration.

9. The platform of claim 1, wherein an engagement mechanism is operable to slide a portion of each of the plurality of legs into and out of a respective leg sheath.

10. A platform for facilitating shaving, consisting of:
a base;
a plurality of legs extending outwardly from a bottom surface of the base;
a plurality of stabilizers attached to ends of the plurality of legs;
at least one receptacle;
wherein the base includes a first plurality of holes;
wherein the plurality of stabilizers each include a stem portion and a foot portion;
wherein the plurality of legs are pivotably attached to the base, and wherein the plurality of legs are operable to fold along an axis substantially parallel to one or more sides of the base;
wherein the foot portion of the plurality of stabilizers is formed from an anti-slip material;
wherein the plurality of legs and the plurality of stabilizers are fully contained under a bottom surface of the base when the stem portions of the plurality of stabilizers are retracted within the plurality of legs and when the plurality of legs are folded along the axis substantially parallel to the one or more sides of the base;
wherein each of the plurality of legs is nested within a pivot mechanism connected to the bottom surface of the base;
wherein the at least one receptacle extends below the bottom surface of the base;
wherein the at least one receptacle includes a second plurality of holes;
wherein the base includes a first opening and a second opening; and
wherein the second opening is a different size than a first opening.

11. The platform of claim 10, wherein the at least one receptacle is removably connected to the platform.

12. The platform of claim 10, wherein the at least one receptacle includes a cover operable to slide in order to open or close the at least one receptacle.

13. The platform of claim 10, wherein one or more of the plurality of legs are attached to a leg sheath.

14. The platform of claim 11, wherein the leg sheath is an outer tube having a larger diameter than the plurality of legs.

15. The platform of claim 10, wherein each of the foot portions of the plurality of stabilizers have a diameter larger than the diameter of the stabilizer stems.

16. The platform of claim 10, wherein the height of the legs is adjustable.

17. A platform for facilitating shaving, consisting of:
a base;
a plurality of legs extending outwardly from a bottom surface of the base;
a plurality of stabilizers attached to ends of the plurality of legs;
at least one receptacle;
wherein the base includes a first plurality of holes;
wherein the plurality of stabilizers each include a stem portion and a foot portion;
wherein the stem portion of the plurality of stabilizers is configured to retract within the plurality of legs;
wherein the plurality of legs are pivotably attached to the base, and wherein the plurality of legs are operable to fold along an axis substantially parallel to one or more sides of the base;
wherein the plurality of legs and the plurality of stabilizers are fully contained under a bottom surface of the base when the stem portions of the plurality of stabilizers are retracted within the plurality of legs and when the plurality of legs are folded along the axis substantially parallel to the one or more sides of the base;
wherein the at least one receptacle extends below the bottom surface of the base; and
wherein the at least one receptacle includes a second plurality of holes.

18. The platform of claim 17, wherein the at least one receptacle is removably connected to the platform.

19. The platform of claim 17, wherein the at least one receptacle includes a cover able to slide in order to open or close the at least one receptacle.

20. The platform of claim 17, wherein each of the plurality of legs is nested within a pivot mechanism connected to the bottom surface of the base.

* * * * *